US005667126A

United States Patent [19]

Boucek

[11] Patent Number: 5,667,126

[45] Date of Patent: Sep. 16, 1997

[54] TOOL FOR ACTUATING A PAIR OF FASTENER EJECTING GUNS

[76] Inventor: Robert V. Boucek, 9221-4 Olsmted Dr., Charlotte, N.C. 28262

[21] Appl. No.: 398,493

[22] Filed: Mar. 3, 1995

[51] Int. Cl.[6] ..... B25C 1/04

[52] U.S. Cl. ..... 227/109; 227/130; 227/148; 227/156

[58] Field of Search ..... 227/109, 78, 56, 227/156, 148, 30, 130, 110; 29/243.523, 798

[56] References Cited

U.S. PATENT DOCUMENTS

| | | | |
|---|---|---|---|
| 3,402,869 | 9/1968 | Otis | 227/152 |
| 4,126,259 | 11/1978 | Galer et al. | 227/30 |
| 4,127,226 | 11/1978 | Jasper | 227/148 |
| 4,288,016 | 9/1981 | Failla et al. | 227/30 |
| 4,989,438 | 2/1991 | Simon | 227/130 |
| 5,524,807 | 6/1996 | Bullard | 227/109 |

*Primary Examiner*—Rinaldi I. Rada
*Assistant Examiner*—Boyer Ashley
*Attorney, Agent, or Firm*—Morton J. Rosenberg; David I. Klein

[57] ABSTRACT

A tool (100) is provided for actuating a pair of fastener ejecting guns (30, 330 and 40, 340). The fastener ejecting guns (30, 330 and 40, 340) are secured to a handle assembly (110, 200) in parallel relation, and in a predetermined angular relationship, one with respect to the other. Tool (100) further includes a trigger assembly (124, 240) for displacing the respective actuating levers (32, 332 and 42, 342) of the fastener ejecting guns (30, 330 and 40, 340). The trigger assembly (124, 240) includes a trigger member (128, 248) which is coupled to an actuating bar member (126, 246) having opposing ends (125, 242 and 127, 244) for respectively displacing the actuating levers of the fastener ejecting guns. Thus, when a user displaces the trigger member (128, 248) both fastener ejecting guns (30, 330 and 40, 340) are actuated to drive a pair of fasteners in two different directions.

14 Claims, 9 Drawing Sheets

TOOL FOR ACTUATING A PAIR OF FASTENER EJECTING GUNS

BACKGROUND OF THE INVENTION

1. Field of the Invention

This invention directs itself to fastener ejecting guns for securement of a workpiece to a substrate. In particular, this invention directs itself to a handle assembly for supporting a pair of fastener ejecting guns and actuating both to simultaneously drivingly deliver a pair of fasteners in two different directions. Still further, this invention directs itself to a tool having a handle disposed between a pair of supporting members between which are coupled a pair of fastener ejecting guns. More in particular, this invention pertains to a tool having a trigger assembly pivotally coupled to a handle assembly for substantially simultaneously actuating each of a pair of fastener ejecting guns responsive to pivotal displacement of the trigger actuating assembly. Further, this invention directs itself to a tool having an air distribution assembly incorporated into a rear support member thereof.

2. Prior Art

Tools for applying a corner bead to a dry wall are well known in the art. The best prior art known to Applicant include U.S. Pat. Nos. 5,333,483; 4,989,438; 4,288,016; 4,738,071; 5,267,391; 5,320,268; 4,610,381; 4,670,957; 4,593,443; 4,670,957; 2,944,262; 2,859,445; 3,130,890; and, 969,471.

Some prior art systems, such as that shown in U.S. Pat. No. 4,989,438, are directed to a system for driving a pair of fasteners into a protective corner strip. Such systems utilize a pair of striking elements formed as part of a toggle mechanism which is moved responsive to displacement of a reciprocated shaft of a powered actuator. However, in addition to the complex mechanics formed by the linkage between the striking elements and the reciprocated shaft, the driving force which is applied by the reciprocated shaft must be divided between the pair of striking members, requiring the user to support the tool against a very large reaction force. Whereas in the present invention the two actuators are disposed in an angular relationship such that a portion of the reaction force of one actuator is opposed by the reaction force of the other. Thus, for the present invention, where the actuators are disposed in an orthogonal relationship, the user will only be exposed to half the total reaction force, which is therefore equivalent to the forces generated by a single actuator applying a single fastener.

In other prior art systems, such as that disclosed by U.S. Pat. No. 4,288,016, there is provided a tool for applying plastic corner bead utilizing a pair of mechanically operated staple guns. The staple guns are pivotally supported about an axis transverse to the longitudinal axis of each of the staple guns with a displaceable handle configured to displace the operating levers of each of the staple guns as the handle lever is inwardly displaced. This system also provides for a pair of transversely spaced abutment members having notches formed therein to act as a guide for applying the tool. A tubular handle is disposed between one abutment and the pair of staple guns, disposed orthogonally with respect to the actuating handle. Thus, this system is difficult to support and operate, requiring two hands to operate.

SUMMARY OF THE INVENTION

A tool for actuating a pair of fastener ejecting guns substantially simultaneously is provided. Each of the pair of fastener ejecting guns has an actuating member disposed adjacent one of a pair of opposing longitudinal ends thereof for triggering ejection of a fastener. The tool includes a handle assembly coupled to each of the opposing longitudinal ends of each of the pair of fastener ejecting guns for supporting the pair of fastener ejecting guns in substantially parallel relation and in a predetermined angular relationship, one with respect to the other. The tool also includes a trigger actuating assembly pivotally coupled to the handle assembly for a substantially simultaneous displacement of the actuating members of each of the pair of fastener ejecting guns responsive to pivotal displacement of the trigger actuating assembly.

DESCRIPTION OF THE PREFERRED EMBODIMENTS

Figure 1:
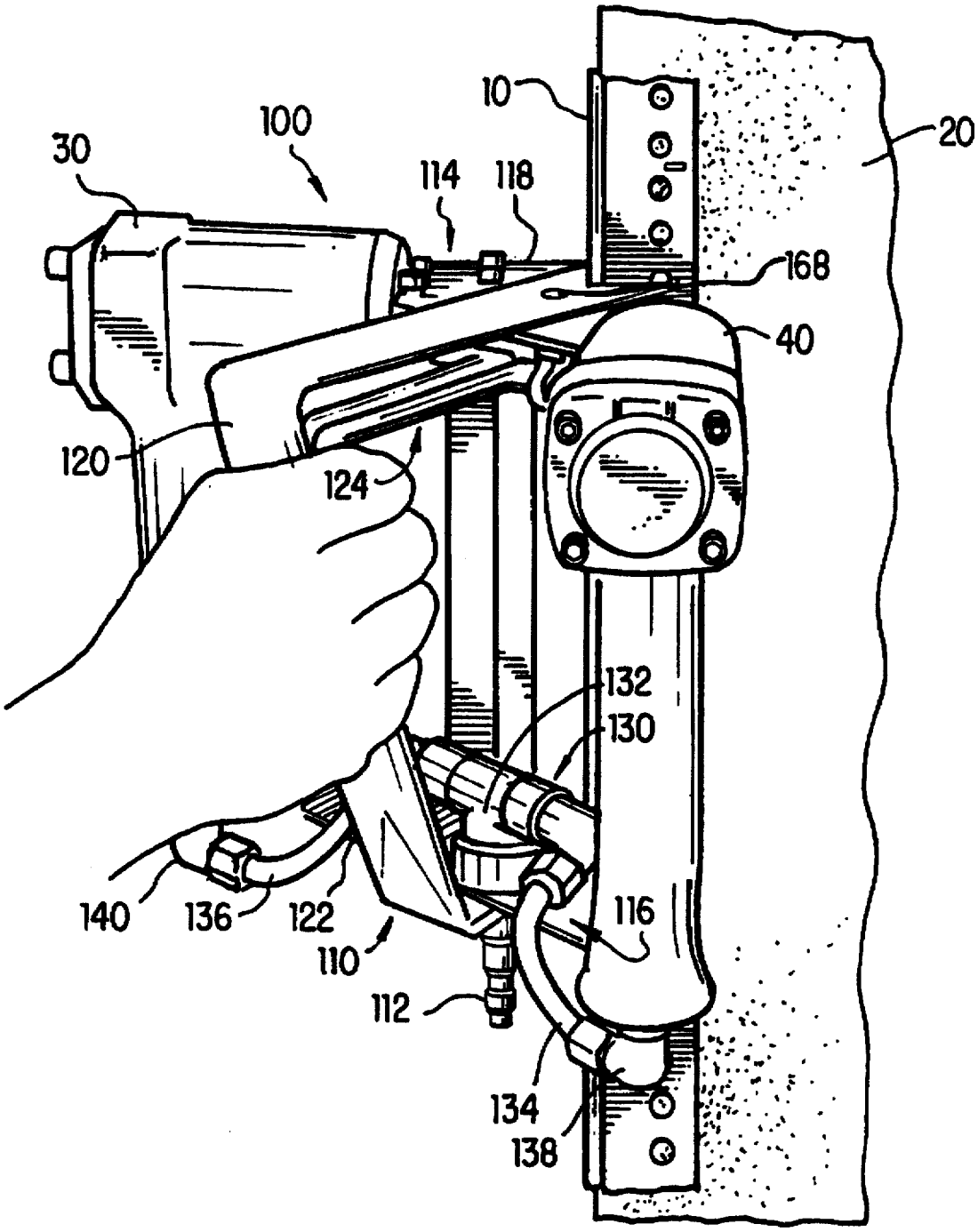
FIG. 1 is a perspective view of one embodiment of the first embodiment of the present invention applied to the installation of a corner bead.

Referring now to FIGS. 1–10, there is shown a tool 100 for actuating a pair of fastener ejecting guns. As will be seen in following paragraphs, tool 100 is specifically directed to the concept of providing a handle assembly 110, 200 for supporting a pair of fastener ejecting guns 30, 330 and 40, 340 in substantially parallel relation, and in a predetermined angular relationship, one with respect to the other. For the particular application illustrated, the two fastener ejecting guns 30, 330 and 40, 340 are maintained in substantially orthogonal relationship so as to provide an efficient means for securing such workpieces as the corner bead 10 to an outside corner joint of drywall panels 20. In other applications, however, the relationship between the pair of fastener ejecting guns may be other than 90°, the particular angular relationship being adapted to conform to the angular relationship between the surfaces into which the fasteners are being driven.

Although tool 100 is not restricted to any particular type of driving system, as such may be mechanical, electrical or a fluid driven system, handle assembly 110, 200 is particularly adapted to supply power to the fastener ejecting guns 30, 330 and 40, 340 through a fluid distribution assembly 130, 294. The fluid distribution assembly 130, 294 conveying compressed air from an air inlet coupling 112, 296 to each of the fastener ejecting guns 30, 330 and 40, 340. By virtue of a trigger assembly 124, 240, tool 100 provides a convenient and efficient means for substantially simultaneously operating a pair of fastener guns such that fasteners are ejected in two different directions. Therefore, tool 100 has applications beyond that of assembling corner bead to wall panels, such as in the assembly of picture frames, the construction of furniture, or anywhere wherein it is desired to simultaneously drive fasteners in different directions.

Referring now to FIGS. 1–4, there is shown, tool 100 for the securement of the corner bead member 10 to a pair of intersecting drywall panels 20. Tool 100 includes a handle assembly 110 which supports the two fastener ejecting guns 30 and 40 having longitudinally directed axes disposed in substantially parallel relation and fastener ejection axes disposed in a predetermined angular relationship, one with respect to the other. For the standard type corner bead which is utilized for outside 90° corners, the two fastener ejecting guns 30 and 40 are maintained in an orthogonal relationship to thereby correspond with the respective sides of corner bead 10.

The type of fastener ejected by the respective guns 30 and 40 are not important to the inventive concept, such being a function of the particular application to which tool 100 is being applied. It is contemplated that such fasteners as nails, staples, rivets, and the like may be driven by guns 30 and 40. It is further contemplated that each of the guns 30 and 40 may drive a different type of fastener, such that one gun may eject staples while the other ejects nails. The guns 30 and 40 may each be mechanically powered, electrically powered or powered from a fluidic source. For commercial applications, pneumatically operated guns which are supplied from a source of compressed air are highly desirable and are therefore shown and described in the embodiments illustrated herein. However, such is not a limitation on the scope of the instant invention.

Handle assembly 110 includes a front support assembly 114, a rear support assembly 116, and a handle member 120 extending between and secured to the front support assembly 114 and rear support assembly 116. Tool 100 further includes a trigger assembly 124 pivotally coupled to handle assembly 110 for simultaneously actuating the operation of the two fastener ejecting guns 30 and 40. In the particular embodiment shown in FIGS. 1–4, fastener ejecting guns 30 and 40 are pneumatically operated staple guns, each having a respective air inlet coupling 140, 138 to which is supplied compressed air. The compressed air is supplied from an external source to the air inlet coupling 112, which is one element of a conventional quick disconnect coupling. The air supplied to inlet coupling 112 flows through the tee coupling 132 and the respective air passages 136, 134 for conveyance to respective air inlet couplings 140, 138 of the fastener ejecting guns 30, 40.

Figure 2:
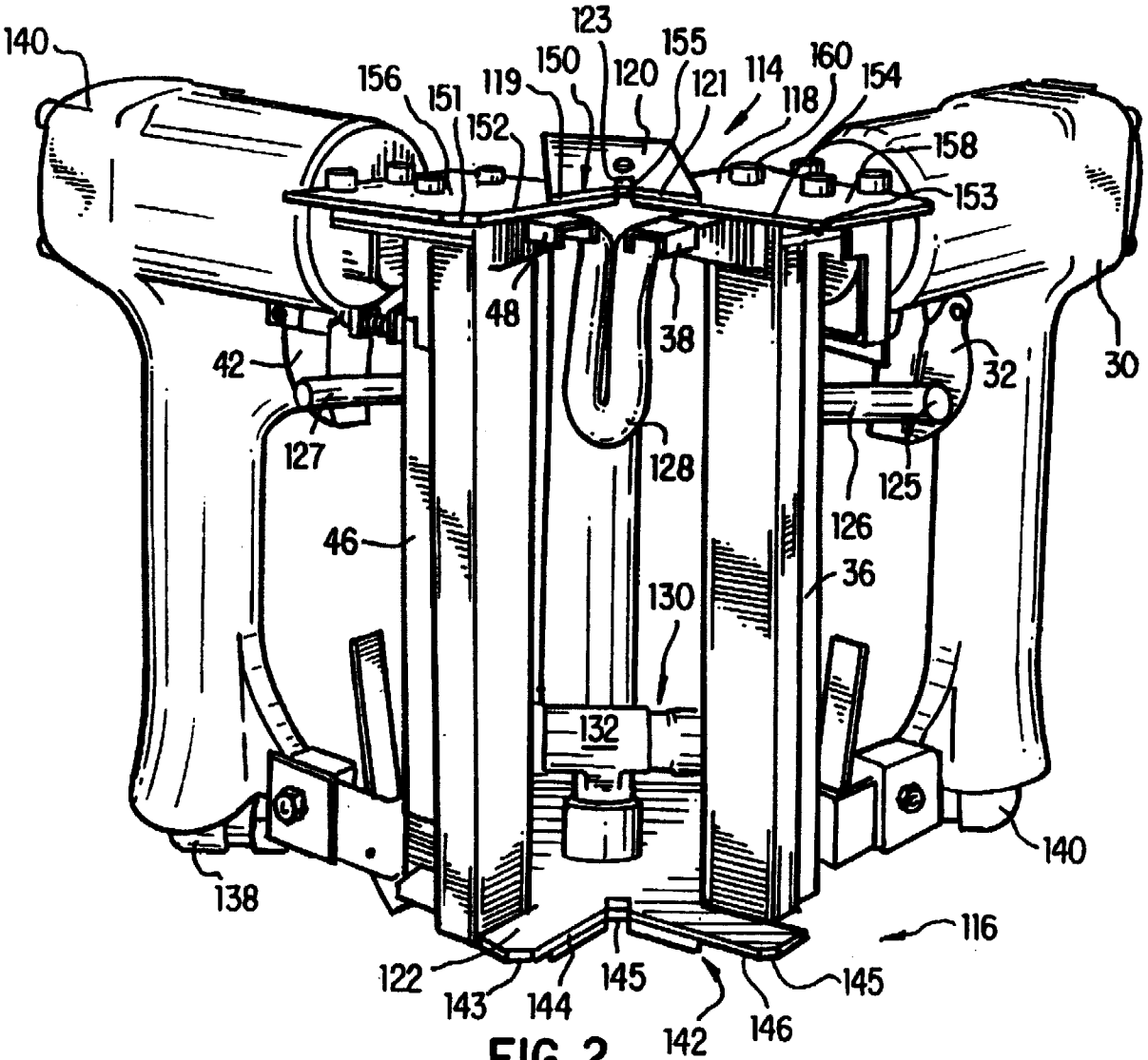
FIG. 2 is a perspective bottom view of the first embodiment of the present invention.
Figure 3:
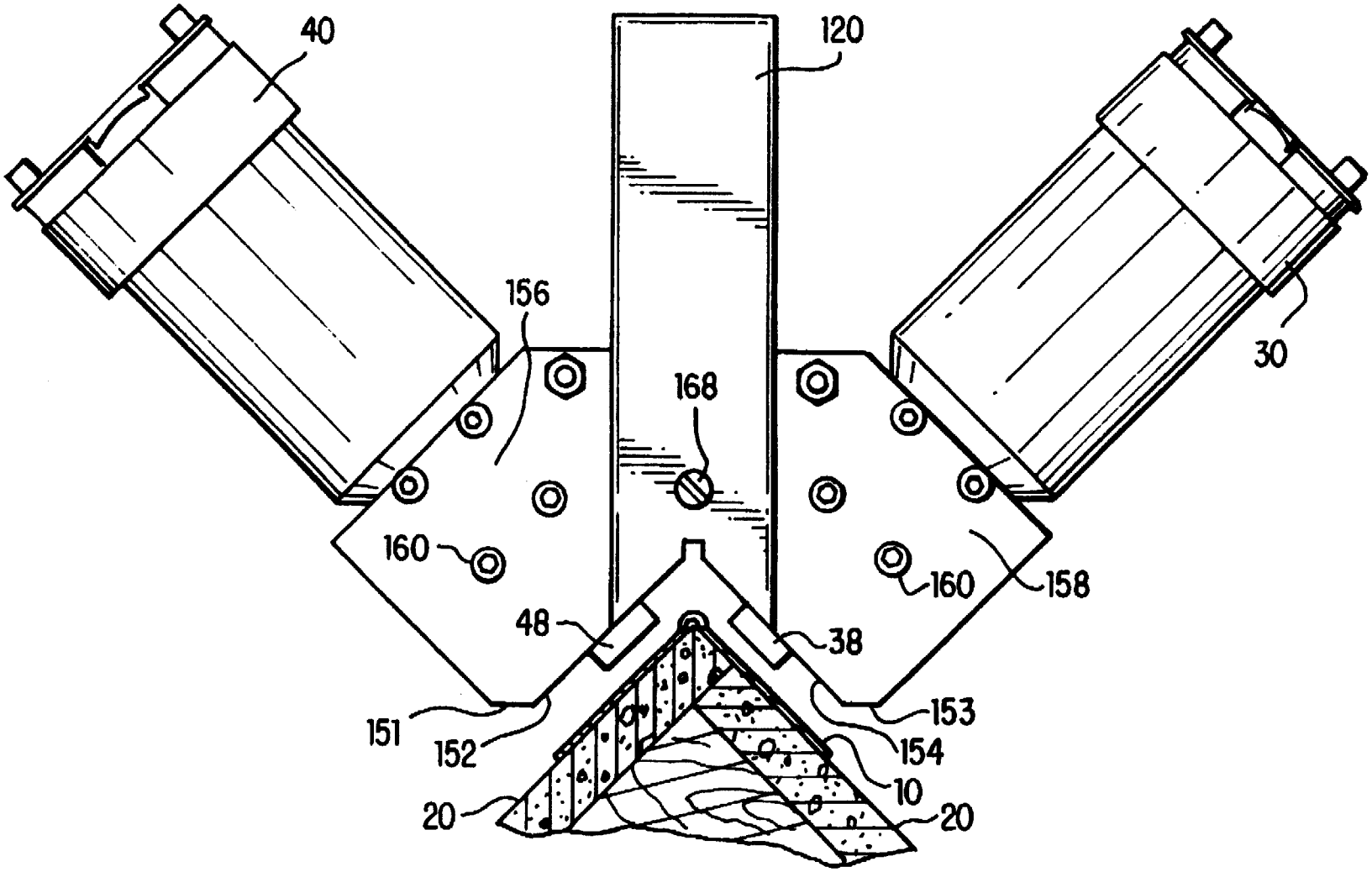
FIG. 3 is a front elevation view of the first embodiment of the present invention.
Figure 4:
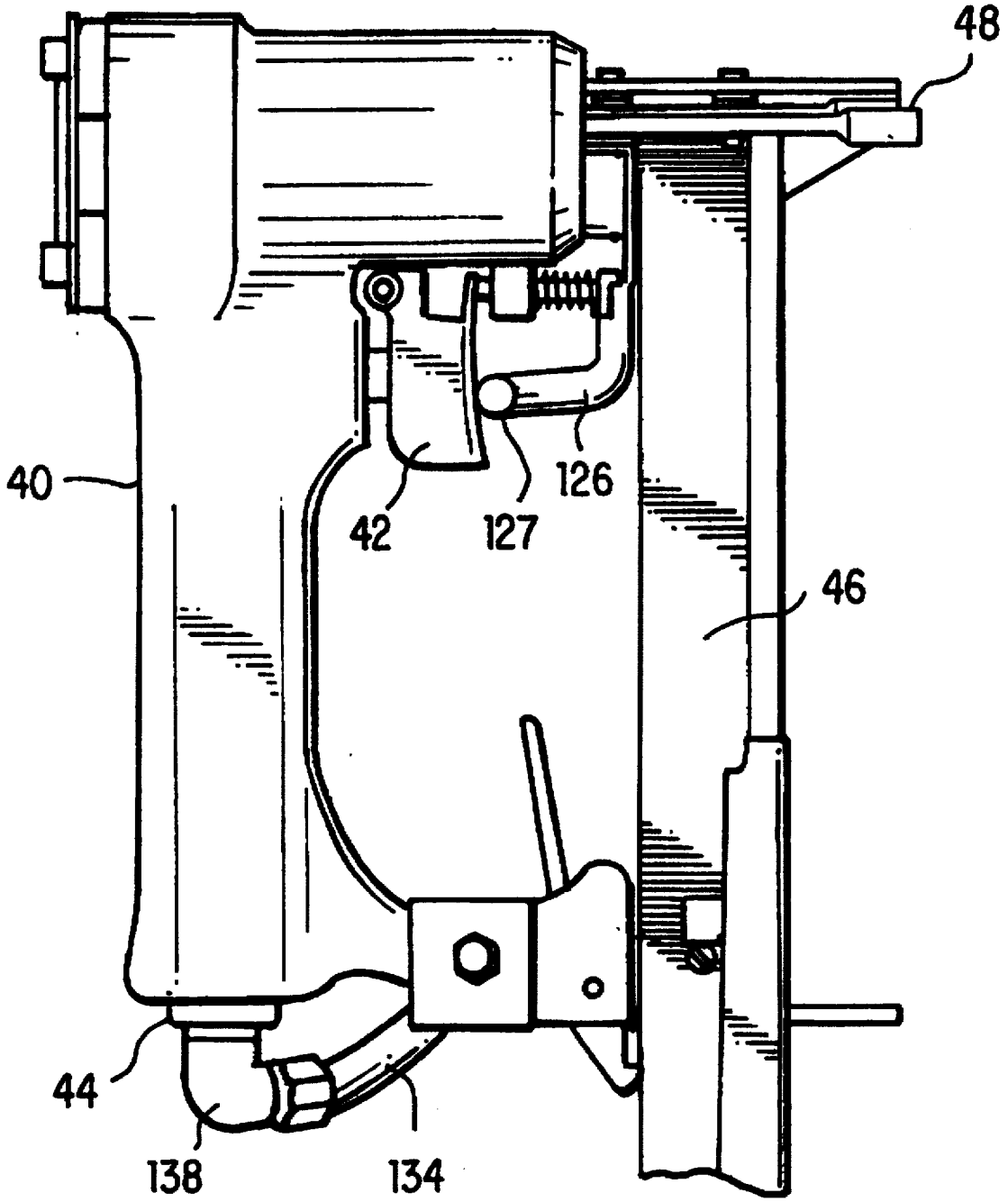
FIG. 4 is a side elevation view of the first embodiment of the present invention.

Referring now to FIG. 2, it can be seen that each of the air operated staple guns 30, 40 are operated responsive to displacement of a respective actuating lever or trigger 32, 42 to cause the ejection of a fastener, when such occurs subsequent to the respective retractable shoe 38, 48 being displaced by pressing such against the workpiece, as is conventional. Each of the pneumatic staple guns 30 and 40 are provided with a fastener magazine 36, 46 in which is carried a supply of staples which are subsequently drivingly dispensed therefrom. As such pneumatic staple guns are conventional in structure and commercially available, they will not be described in any further detail.

The front support assembly 114 includes a front support member 118. The front support member 118 has a bottom wall or edge 152, 153 into which a notch 150 is formed. Notch 150 is defined by a pair of inclined wall surfaces 152, 154, which will contact the respective sides of workpiece 10. The two inclined walls 152, 154 terminate in a groove 155, which may not be required if the sides of the workpiece intersect without forming any type of projection. Groove 155 provides clearance for the raised end of the corner bead 10, and may be shaped to accommodate the particular type of corner bead being installed, such as the standard configuration shown in FIGS. 1 and 3, or what is known as the bullnose-type of corner bead configuration, not shown.

The handle member 120 may also have inclined end wall portions 119, 121, each overlaying a portion of a respective inclined wall 152, 154, and terminating in a clearance groove 123 aligned with the groove 155 and having the same contour thereof. The front support member 118 further includes respective mounting portions 156 and 158 disposed on opposing sides of the notch 150. Each of the mounting portions 156, 158 includes a plurality of through openings for securing the respective fastener ejecting guns 30, 40 thereto by means of threaded fasteners 160. The threaded fasteners pass through the openings formed in each respective mounting portion 156, 158 of front support member 118 for engagement with threaded openings formed in the front end of each fastener ejecting gun 30, 40.

The rear support assembly 116 includes a rear support member 122 having a bottom wall or edge 143, 145 into which is formed a notch 142. The rear notch 142 is formed by a pair of inclined wall surfaces 144, 146, the two inclined walls 144, 146 terminating in a clearance groove 145. Groove 145, like groove 155, may be provided in various configurations to match the type of material being secured by tool 100. Further, the end surface of the handle 120 adjacent the notch 142 may be provided with inclined wall surfaces and a groove to correspond to the configuration of the rear support member 122, as was described for the opposing front end of handle 120, which is secured to the front support member 118.

Handle member 120 extends between front support member 118 and rear support member 122. The handle member 120 is disposed between the two fastener ejecting guns 30 and 40, and in parallel relation therewith. The handle member 120 is centered over both the front notch 150 and the rear notch 142, making it easy to align tool 100 over the workpiece 10. Handle member 120 may be secured on opposing ends to the respective front and rear support members 118, 122 by one or more threaded fasteners 168. Other means of attachment may of course be substituted for fasteners 168 without departing from the inventive concept, as described herein. Handle member 120 may be formed of a metallic material composition, plastic, wood, or any like material having sufficient structural integrity.

Figure 5:
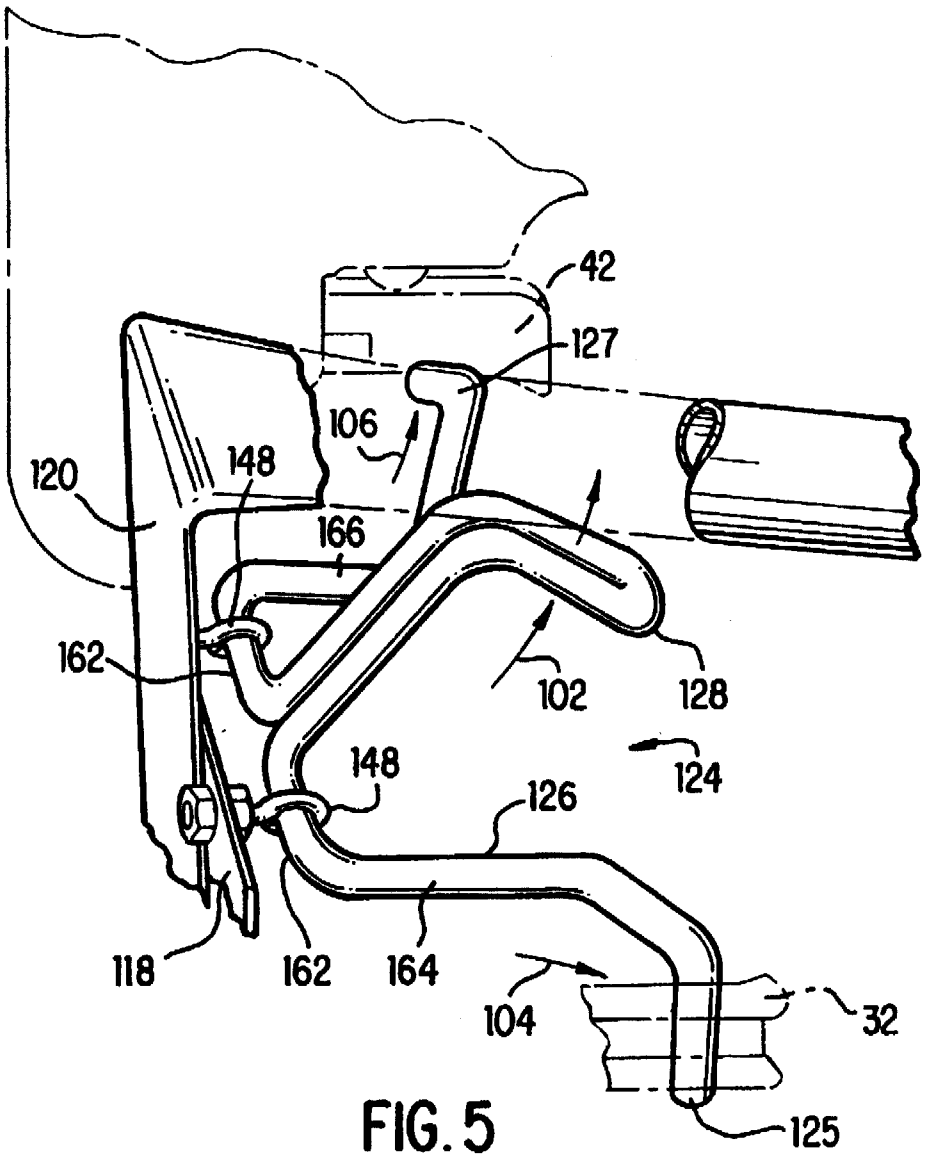
FIG. 5 is an enlarged perspective view of the trigger assembly of the first embodiment of the present invention.
Figure 6:
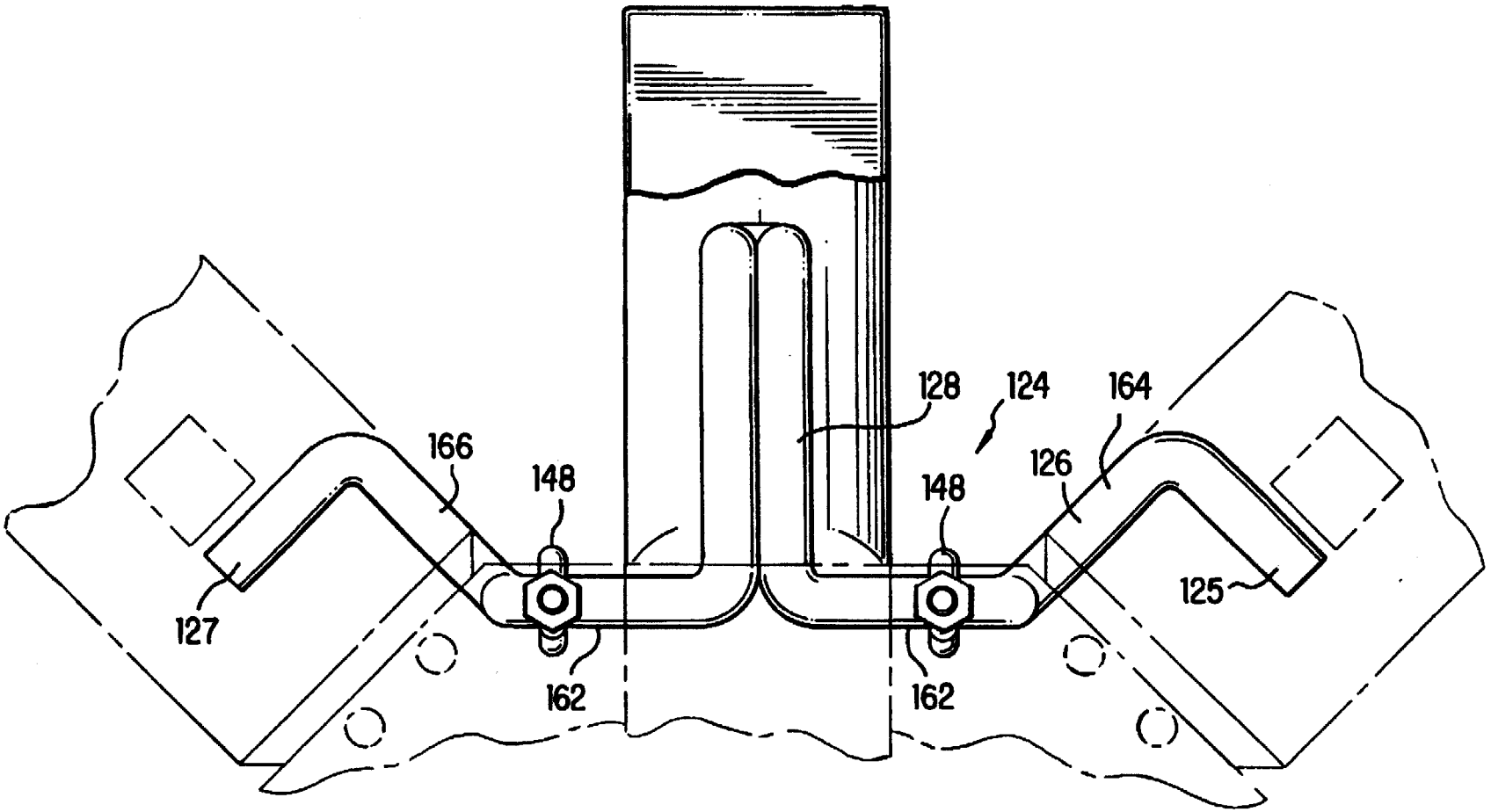
FIG. 6 is an enlarged elevation view of the trigger assembly of the first embodiment of the present invention.

Referring additionally to FIGS. 5 and 6, it can be seen that tool 100 includes a trigger assembly 124. In overall concept, the trigger assembly permits a user to displace a trigger member 128 in order to substantially simultaneously actuate each of the fastener ejecting guns 30 and 40. The trigger assembly 124 is pivotally coupled to the handle assembly 110 with the trigger member 128 being coupled to an actuating bar member 126. In the particular embodiment shown in FIGS. 2, 5 and 6, the trigger member 128 is integrally formed with the actuating bar member 126, in one-piece formation. Obviously, the trigger member 128 may be a separate element which is affixed to the actuating bar member by means of fasteners, adhesives, welding, or soldering type methods.

The actuating bar member 126 is defined by a rod-like member which has been configured to have a central portion 162 which passes through a pair of pivotal coupling elements 148 in a direction transverse to the direction of handle member 120, a pair of extending arm portions 164, 166 which are rearwardly directed, and a pair of trigger contacting end portions 125, 127. Each of the pivotal coupling elements 148 may be formed by an annular ring through which the central portion 162 of the actuating bar member 126 passes. Each of the pivotal coupling elements 148 being secured to the front support member 118 by conventional means. Thus, when the trigger member 128 is rotated in the direction indicated by the directional arrow 102, the respective end portions 125, 127 are displaced in a direction indicated by the respective directional arrows 104, 106. By this arrangement, the respective end portions 125, 127 of the actuating bar member 126 displace the respective actuating levers 32, 42 for the fastener ejecting guns 30, 40 to cause each such gun to drive a fastener into the workpiece, responsive to the trigger member 128 being displaced toward the handle member 120.

It can therefore be seen how tool 100 can facilitate assembly of such workpieces as corner bead strips 10 to dry wall panels 20. Tool 100 is properly aligned over the workpiece using front notch 150 and rear notch 142, which together function as an alignment guide. The inclined surfaces 152, 144 and 154, 146 being placed in contiguous contact with respective sides of the workpiece 10. As the handle member 120 is centered over the notches 150 and 142, and extends between the front and rear support members, the user of tool 100 is able to apply an appropriately distributed force to support tool 100 in contact with the corner bead 10 and properly displace the retractable shoes 38 and 48 of the staple guns 30 and 40. The user may then displace the trigger member 128 toward the handle member, which in turn causes the actuating ends 125 and 127 of actuating bar member 126 to be displaced. Each actuating end 125, 127 is positioned adjacent a respective staple gun trigger 32, 42, and causes displacement thereof responsive to displacement of the trigger member 128. In this manner, both staple guns 30 and 40 are actuated substantially simultaneously to drivingly eject fasteners. The two fasteners ejected being directed in different directions, the directions for the particular embodiment shown being substantially orthogonal.

Figure 7:
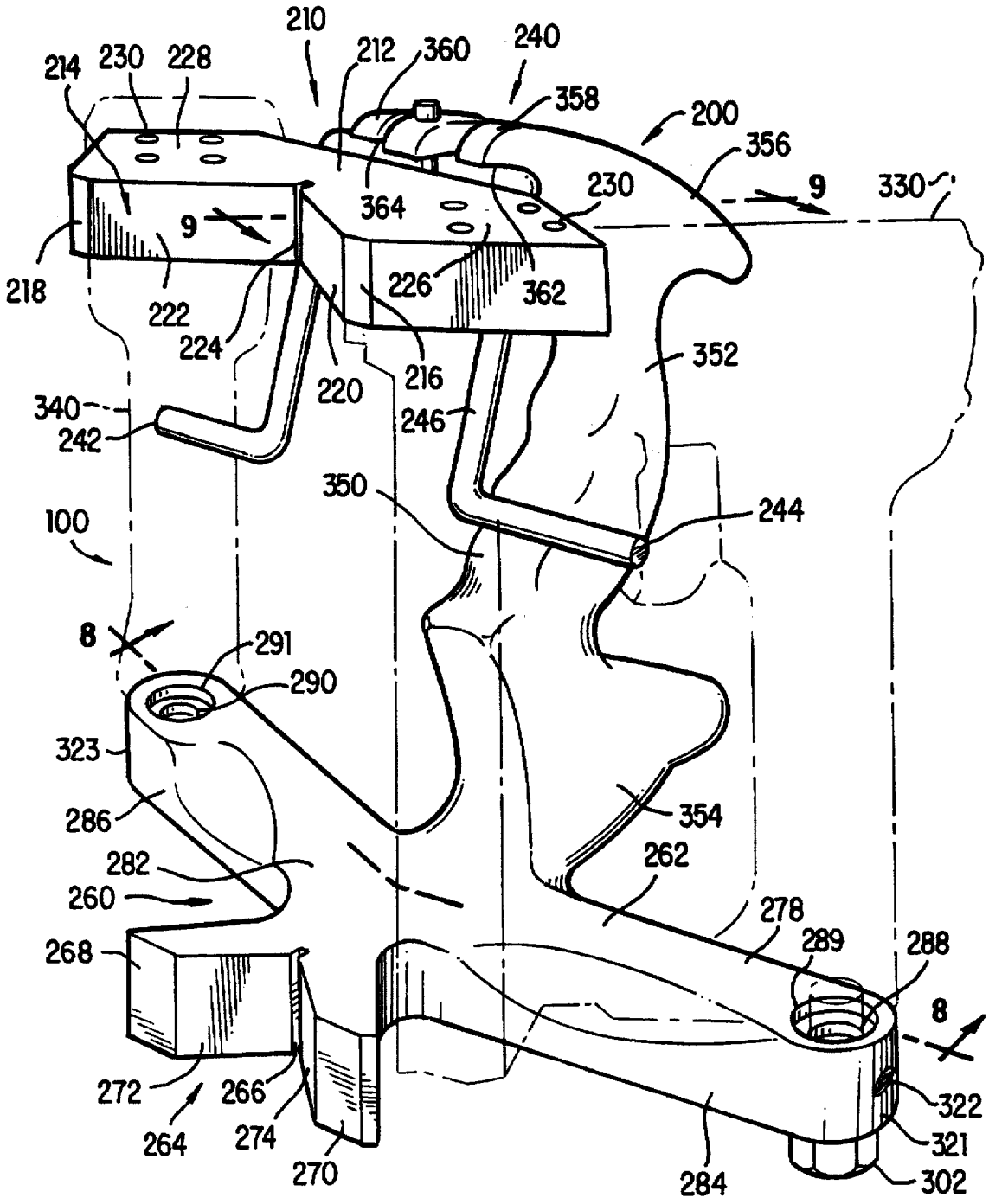
FIG. 7 is a perspective view of a second embodiment of the present invention.
Figure 10:
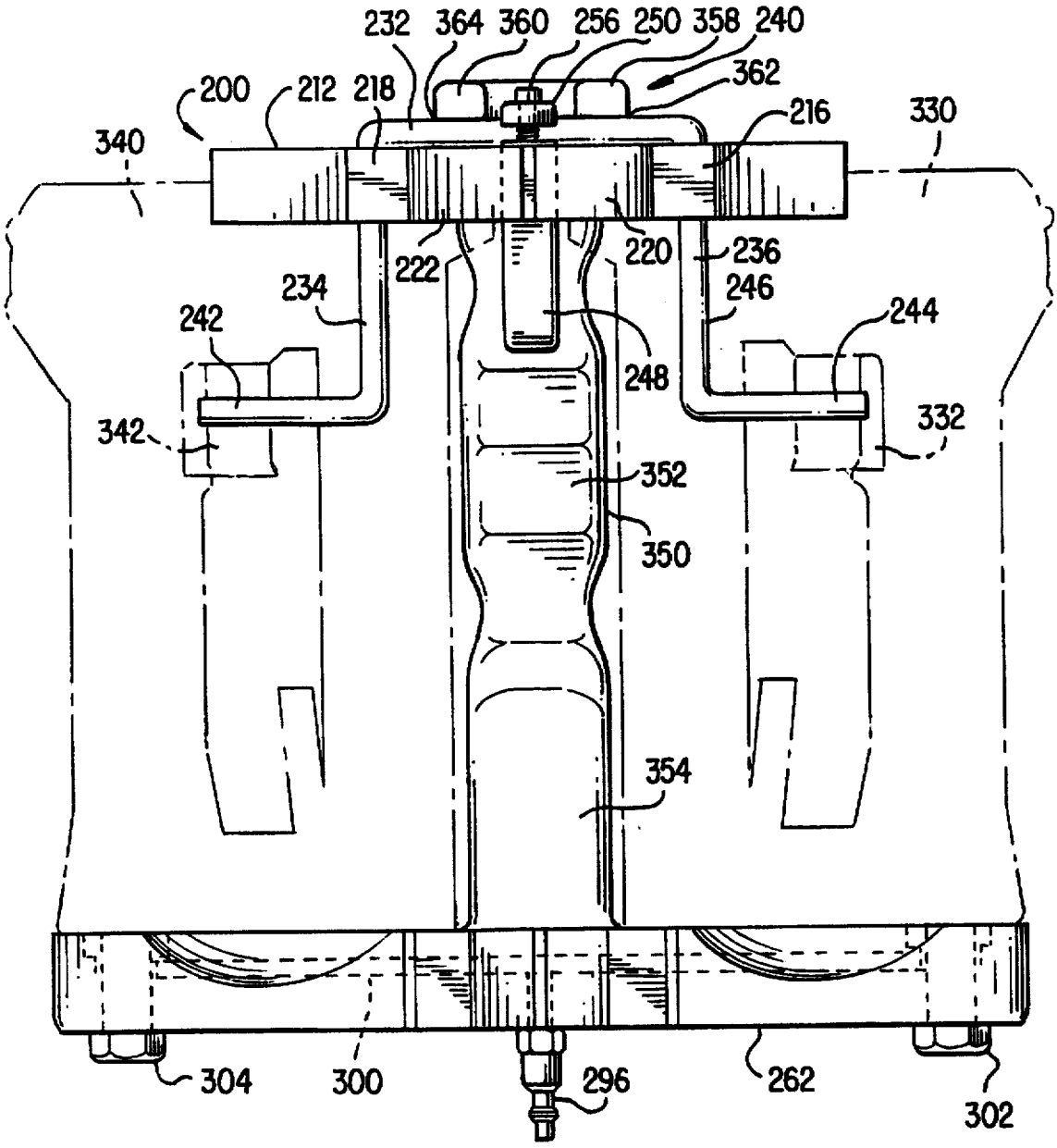

In a second embodiment, shown in FIGS. 7 and 10, the tool 100 is defined by a handle assembly 200 for supporting opposing ends of each of a pair of fastener ejecting guns 330, 340. The fastener ejecting guns 330, 340 may be identical to those described for the first embodiment. Handle assembly 200 includes a front support assembly 210, a rear support assembly 260 disposed in parallel relation with the front support assembly 210 and a handle member 350. Handle assembly 200 may be formed in one-piece formation or assembled utilizing fasteners or adhesive means.

Handle member 350 extends between the front support assembly 210 and the rear support assembly 260, and is disposed in parallel relation with the two fastener ejecting guns 330 and 340. Handle member 350 is particularly adapted for two-handed operation, having a first portion 352 for gripping by one of a user's hands and a second portion 354 for gripping by the other hand of the user. By way of the pair of hand grip portions, a user can more easily stabilize the position of the tool and apply pressure to the workpiece while the fasteners are being driven.

The front support assembly 210 includes a substantially planar front support member 212 having a bottom wall 216, 218 in which is formed a notch 214. The notch 214 is defined by a pair of inclined walls 220, 222 extending between respective bottom wall portions 216, 218 and a clearance groove 224. The particular configuration of the clearance groove 224 is determined by the type of material being fastened and is only required for workpieces having a projection extending from the corner thereof. As in the previous embodiment, the front support member 212 is provided with a pair of mounting portions 226, 228 disposed on opposing sides of the notch 214. Each mounting portion 226, 228 is formed with a plurality of through openings 230 for passage therethrough of threaded fasteners for securement of the front end of a respective one of the fastener ejecting guns 330, 340 to each mounting portion 226, 228.

Tool 100 includes a trigger assembly 240 pivotally coupled to handle assembly 200. The trigger assembly 240 includes a trigger member 248 secured to an actuating bar member 246 which is pivotally coupled to the handle assembly 200. In particular, the front end portion 356 of handle member 350 is provided with a pair of clamping members 358, 360 disposed in spaced parallel relation. The actuating bar member 246 extends through the respective recess openings 362, 364 formed between the respective clamping member 358, 360 and the upper surface of the front support member 212. Thus, while the actuating bar member 246 is clampingly engaged within the recess openings 362, 364, such is free to rotate therein. Therefore, as the trigger member 248 is pivotally displaced, the actuating bar member rotates therewith.

Actuating bar member 246 is defined by a central portion 232 extending transversely across the face of the front support member 212 and a pair of opposing rearwardly extending arm portions 234 and 236. Each arm portion 234, 236 has a respective end portion 242, 244 for displacing respective actuation levers 342, 332. Although not important to the inventive concept, actuating bar member 246 may be fabricated form a metallic rod-shaped member which is configured as described above for contacting and displacing the actuating levers of both fastener ejecting guns.

Figure 9:
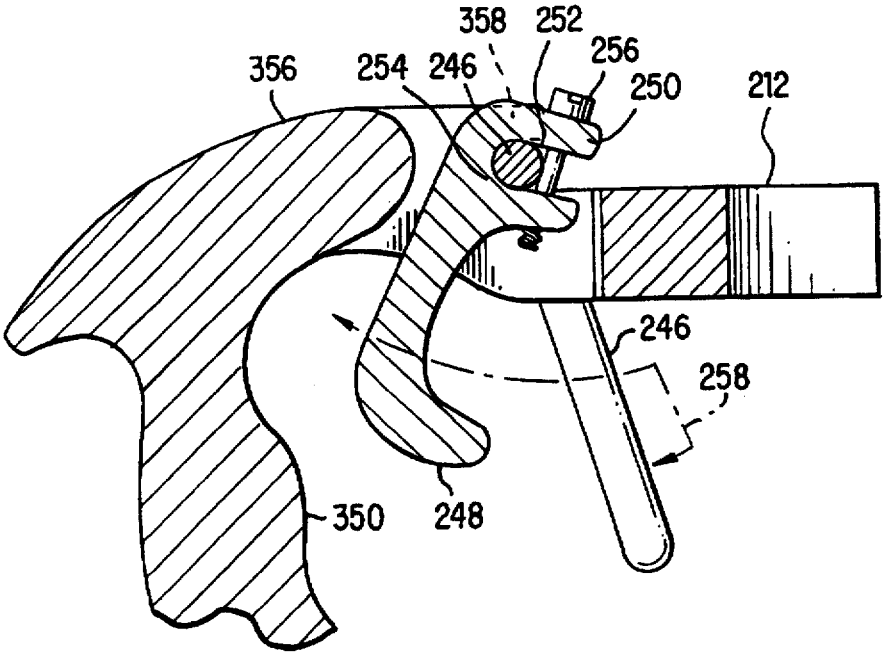
FIG. 9 is a sectional view of the embodiment of FIG. 7 taken along the Section Line 9—9; and, FIG. 10 is a bottom plan view of the second embodiment of the present invention.

Referring further to the cross-sectional view of FIG. 9, the attachment of the trigger member 248 to the actuating bar member can best be seen. The trigger member 248 is formed with a main body portion 254 from which extends a clamping portion 250. A recess 252 is formed between the main body portion 254 and the clamping portion 250, the actuating bar member 246 being disposed within the recess 252. A screw-type fastener 256 passes through an opening formed in the clamping member 250 and is engaged within a respective threaded opening in the main body 254, such that the clamping member 250 may be sufficiently displaced by tightening of the threaded fastener 256 to clampingly engage the actuating bar member 246. Therefore, as the trigger member 248 is pivotally displaced, the actuating bar member 246 will be rotated therewith, as indicated by the directional arrow 258. Thus, when the user draws the trigger member 248 toward the handle member 350, each of the end portions 242, 244 of the actuating bar member 246 will be similarly displaced, and thereby displace respective actuating levers 342, 332 to trigger the driving of a fastener by each such fastener ejecting gun 340, 330.

The rear support assembly 260 includes a substantially planar rear support member 262 having a main or central body portion 282. The central body portion 282 has a bottom wall defined by the wall portions 268, 270 in which a notch 264 is formed. Notch 264 is defined by a pair of inclined walls 272 and 274 which extend between the respective bottom wall portions 268, 270 and a clearance groove 266. Together, the front notch 214 and rear notch 264 define a guide for overlaying the tool 100 on the workpiece 10, with each of the inclined walls 220, 274 and 222, 272 being in contiguous contact with respective sides of the workpiece 10. The rear support member 262 is further defined by a pair of extending arm portions 284, 286, the distal ends of each having through openings 288, 290 formed therein for passage of a respective air coupling member 302, 304, which provides both fluid coupling to a respective fastener ejecting gun and securement of the rear end of the gun to the rear support member 262. The through openings 288, 290 may be provided with a concentrically formed recess opening 289, 291, formed in the inside surface 278 of rear support member 262, for providing clearance for the air inlet structure of the fastener ejecting gun 330, 340.

Figure 8:
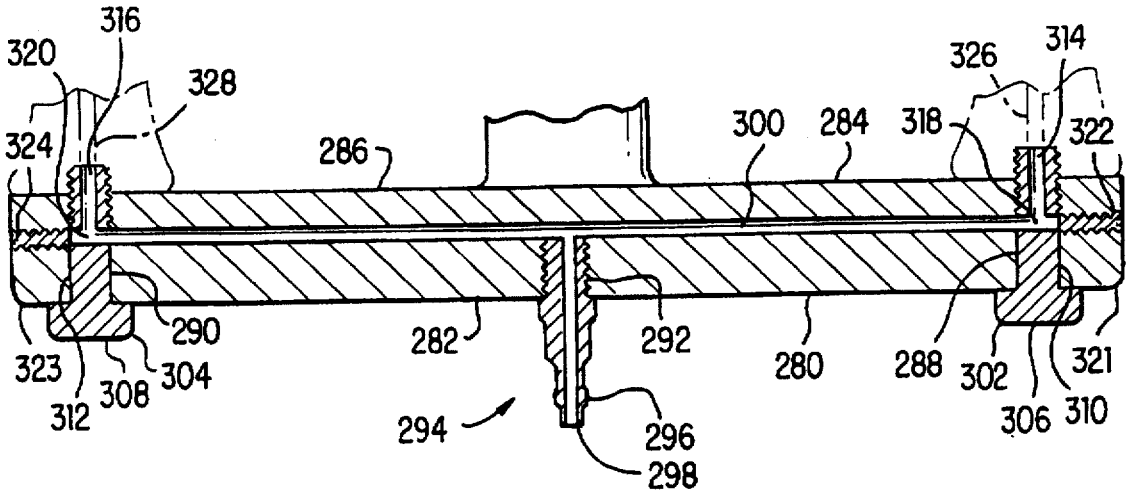
FIG. 8 is a sectional view of the embodiment of FIG. 7 taken along the Section Line 8—8.

Tool 100 further includes an air distribution assembly 294 which may be integrated into the rear support member 262, thereby becoming a subassembly of rear support assembly 260. As best seen in FIGS. 8 and 10, air distribution assembly 294 includes an air inlet coupling 296, which may be one element of a conventional quick disconnect connector, well known to those who utilize pneumatic power tools. Air inlet coupling 296 is threadedly engaged within a threaded opening 292 formed in the rear support member 262, the opening 262 intersecting a transversely directed air passage 300. Thus, the air passage 298 formed in the inlet coupling 296 is coupled in fluid communication with the transverse air passage 300, allowing compressed air from an external source to be conveyed to the air passage 300. Air passage 300 extends between the respective through openings 288 and 290, while also intersecting the opening 292. In the formation of transverse air passage 300, such may be required to extend between the opposing sides 321, 323. Where such extension of passage 300 is required by the manufacturing process, such end portions of passage 300 are sealed by means of threaded closures 322, 324.

In order to convey the compressed air from passage 300 to the respective fastener ejecting gun inlet air passages 326, 328, a pair of air coupling members 302, 304 having both longitudinal and transverse intersecting air passages are provided. Each of the air coupling members 302, 304 have a bolt-like configuration with a respective head portion 306, 308 and a longitudinally extended shank portion 310, 312. The shank portion 310, 312 of each of the air coupling members 302, 304 are provided with at least one transversely directed through bore 318, 320 disposed in aligned relationship with the air passage 300, so as to be in fluid communication therewith. A plurality of transverse through bores 318, 320 may be formed through shank 310, 312 in radially spaced relation in order to insure alignment with air passage 300. Alternatively, the shank portions 310, 312 can be relieved to form an annular recess in which the transverse bores 318, 320 are formed, or the through openings 288, 290 undercut in the region of their intersection with passage 300, in order to provide fluid communication with the transverse bores 318, 320. Each of the shank portions 310, 312 further includes a longitudinally directed bore 314, 316 extending between the distal end of the shank portion 310, 312 and the transverse bore 318, 320, thereby providing a fluid path from passage 300 through transverse bore 318, 320 and longitudinal bore 314, 316 to the respective fastener ejecting gun inlet air passage 326, 328. In an alternate embodiment of tool 100, where electrically operated fastener ejecting guns are utilized, the wiring for such guns may be routed through the passages formed in the coupling members 302, 304 and the transversely directed passage 300 for exit through the opening 292.

The distal end of each air coupling member 302, 304 may be threaded for engagement with an air inlet opening of the respective fastener ejecting guns 330, 340. By this arrangement, the air inlet couplings 302, 304 provide both fluid communication between air inlet coupling 296 and each of the air inlet passages 326 and 328 of the respective guns 330 and 340, and securement thereof to the rear support member 262. Thus, each of the fastener ejecting guns 330 and 340 are secured on the front end thereof to the respective mounting portions 226, 228, and on a rear end thereof to the respective extending arm portions 284 and 286 of the rear support member 262.

Although this invention has been described in connection with specific forms and embodiments thereof, it will be appreciated that various modifications other than those disclosed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A tool for actuating a pair of fastener ejecting guns substantially simultaneously, each of the pair of fastener ejecting guns having a longitudinal axis and an actuating member disposed adjacent one of a pair of opposing longitudinal ends thereof for triggering ejection of a fastener in a direction orthogonal to the longitudinal axis of the fastener ejecting gun to define a fastener ejection axis, comprising:

handle means coupled to each of the opposing longitudinal ends of each of the pair of fastener ejecting guns for supporting the pair of fastener ejecting guns with the longitudinal axis of each of the pair of fastener ejecting guns and a longitudinal axis of said handle means being in substantially parallel relation and the fastener ejection axis of each of the pair of fastener ejecting guns being in a predetermined angular relationship, one with respect to the other, said handle means including (1) front support means for coupling to the pair of fastener ejecting guns, said front support means including a first support member having a bottom surface portion with a first notch formed therein, said first notch being defined by a first pair of inclined wall surfaces formed in said first support member, said first notch being bordered on opposing sides thereof by a pair of mounting portions for coupling to one of said opposing longitudinal ends of the pair of fastener ejecting guns, (2) rear support means coupled to the pair of fastener ejecting guns, said rear support means including a second support member, said second support member having a bottom surface portion with a second notch formed therein, said second notch being defined by a second pair of inclined wall surfaces formed in said second support member, said second support member being disposed in spaced parallel relation with respect to said first support member, said second support member being coupled to the other of said opposing longitudinal ends of the pair of fastener ejecting guns, said first and second notches together defining a guide for alignment of the pair of fastener ejecting guns with a workpiece, said rear support means further including air distribution means coupled in fluid communication with a respective air inlet port of each of said pair of fastener ejecting guns for delivering air thereto, and (3) a handle member extending between said first and second support members and having a longitudinal axis coincident with said longitudinal axis of said handle means; and, trigger actuating means pivotally coupled and rotatably displaceable with respect to said handle means for substantially simultaneous displacement of said actuating member of each of said pair of fastener ejecting guns responsive to said rotative displacement of said trigger actuating means.

2. The tool as recited in claim 1 where said trigger actuating means includes:

a. an actuating bar member pivotally coupled to said handle means and extending between the pair of fastener ejecting guns for displacing the actuating member of each of the pair of fastener ejecting guns; and, b. a trigger member rotatably displaceable with respect to said handle means and coupled to said actuating bar member for rotatively displacing said actuating bar member responsive to rotative displacement of said trigger member.

3. The tool as recited in claim 1 where said handle member has a frontal grip portion for grasping by one of a user's hands and a rear grip portion for grasping by another of a user's hands.

4. The tool as recited in claim 1 where said air distribution means includes:

a. an air inlet coupling secured to said second support member through a first opening formed therein, said second support member having a pair of second openings formed through opposing sides thereof, each of said second openings being disposed in aligned relation with said air inlet port of a respective one of said pair of fastener ejecting guns, said second support member having a fluid passageway formed therein extending between each of said pair of second openings and said first opening; and, b. a pair of fluid coupling members, each of said fluid coupling members being threadedly engaged with an air inlet port of a respective one of said pair of fastener ejecting guns through a respective one of said pair of second openings for providing fluid communication between a respective air inlet port and said air inlet coupling.

5. The tool as recited in claim 4 where each of said pair of fluid coupling members is formed by a bolt member having a head portion and a longitudinally directed shank portion, said shank portion having a longitudinally directed bore extending from a distal end thereof and at least one transversely directed through bore disposed in fluid communication with said fluid passageway and intersecting said longitudinally directed bore to provide fluid communication therebetween and providing securement of a respective fastener ejecting gun to said second support member.

6. The tool as recited in claim 1 where said trigger actuating means includes:

a. an actuating bar member pivotally coupled to said front support means and extending between the pair of fastener ejecting guns for displacing the actuating member of each of the pair of fastener ejecting guns responsive to a rotative displacement thereof; and, b. a trigger member rotatably displacable with respect to said front support means and coupled to said actuating bar member for rotatively displacing said actuating bar member responsive to rotative displacement of said trigger member.

7. The tool as recited in claim 1 where said trigger actuating means includes:

a. an actuating bar member pivotally coupled to said handle member and extending between the pair of fastener ejecting guns for displacing the actuating member of each of the pair of fastener electing guns responsive to a rotative displacement thereof; and, b. a trigger member rotatably displacable with respect to said handle member and coupled to said actuating bar member for rotatively displacing said actuating bar member responsive to rotative displacement of said trigger member.

8. The tool as recited in claim 1 where said handle means is integrally formed in one piece formation.

9. The tool as recited in claim 1 where said handle means is formed of a plastic material composition.

10. A tool for driving a pair of fasteners in two different directions, comprising:

a front support member having a substantially planar contour, said front support member having a bottom surface portion with a first notch formed therein, said first notch being defined by a first pair of inclined wall surfaces formed in said bottom surface portion of said front support member, said first notch being bordered on opposing sides thereof by a pair of mounting portions;

a rear support member having a substantially planar contour, said rear support member having a bottom surface portion with a second notch formed therein, said second notch being defined by a second pair of inclined wall surfaces formed in said bottom surface portion of said rear support member, said rear support member being disposed in longitudinally spaced parallel relation with respect to said front support member;

first means for ejecting fasteners having a longitudinal axis and being coupled between said front and rear support members, said first fastener ejecting means being affixed to a first of said pair of mounting portions and oriented for discharging fasteners in a first direction, said first direction being substantially orthogonal to a respective one of said first pair of inclined wall surfaces bordered by said first mounting portion, said first fastener ejecting means including first means for triggering ejection of a fastener;

second means for ejecting fasteners coupled between said front and rear support members and having a longitudinal axis disposed in substantially parallel relation with said longitudinal axis of said first fastener ejecting means, said second fastener ejecting means being affixed to a second of said pair of mounting portions and oriented for discharging fasteners in a second direction, said second direction being substantially orthogonal to a respective one of said first pair of inclined wall surfaces bordered by said second mounting portion, said second fastener ejecting means including second means for triggering ejection of a fastener;

a handle member extending between said front and rear support members and having a longitudinal axis disposed in substantially parallel relation with said longitudinal axes of both said first and second fastener ejecting means, said first and second notches together defining a guide for alignment of said first and second fastener ejecting means with a workpiece;

trigger actuating means pivotally coupled and rotatively displaceable with respect to said handle member for substantially simultaneous displacement of both said first and second means for triggering ejection of a fastener therewith responsive to said rotative displacement of said trigger actuating means; and, air distribution means coupled in fluid communication with a respective air inlet port of each of said first and second fastener ejecting means for delivering air thereto, said air distribution means including:

a. an air inlet coupling secured to said rear support member through a first opening formed therein, said rear support member having a pair of second openings formed through opposing sides thereof, each of said second openings being disposed in aligned relation with said air inlet port of a respective one of said first and second fastener ejecting means, said second support member having a fluid passageway formed therein extending between each of said pair of second openings and said first opening; and, b. a pair of fluid coupling members, each of said fluid coupling members being threadedly engaged with an air inlet port of a respective one of said first and second fastener ejecting means through a respective one of said pair of second openings for both securement to said second support member and providing fluid communication between a respective air inlet port and said air inlet coupling.

11. The tool for driving a pair fasteners as recited in claim 10 where said trigger actuating means includes:

a. an actuating bar member pivotally coupled to said handle member and extending between said first and second means for triggering ejection of a fastener; and, b. a trigger member clampingly coupled to said actuating bar member for rotatively displacing said actuating bar member to displace said first and second means for triggering ejection of a fastener responsive to rotative displacement of said trigger member.

12. The tool as recited in claim 10 where each of said pair of fluid coupling members is formed by a bolt member having a head portion and a longitudinally directed shank portion, said shank portion having a longitudinally directed bore extending from a distal end thereof and at least one transversely directed through bore disposed in fluid communication with said fluid passageway and intersecting said longitudinally directed bore to provide fluid communication therebetween.

13. The tool for driving a pair fasteners as recited in claim 10 where said handle member has a frontal grip portion for grasping by one of a user's hands and a rear grip portion for grasping by another of a user's hands.

14. The tool for driving a pair fasteners as recited in claim 10 where each of said handle member, said front support member and said rear support member are formed of a plastic material composition.

* * * * *